United States Patent [19]

Presby

[11] 4,081,100

[45] Mar. 28, 1978

[54] SPRING-LOADED DRAWER PARTITION

[75] Inventor: Benedict F. Presby, Plainfield Township, Northampton County, Pa.

[73] Assignee: Knoll International, Inc., Greenwich, Conn.

[21] Appl. No.: 697,367

[22] Filed: Jun. 18, 1976

[51] Int. Cl.[2] ..... B65D 57/00; B65D 85/00

[52] U.S. Cl. ..... 220/22.4; 220/22.1

[58] Field of Search ..... 220/22.1, 22, 22.2, 220/22.3, 22.4, 22.5, 22.6; 217/7, 22, 30, 31

[56] References Cited

U.S. PATENT DOCUMENTS

| | | | |
|---|---|---|---|
| 1,068,190 | 7/1913 | Watson et al. | 220/22.4 |
| 2,761,454 | 9/1956 | Reimer | 220/22.5 |
| 3,656,651 | 4/1972 | Hage | 220/22.3 |

*Primary Examiner*—George E. Lowrance
*Assistant Examiner*—Steven M. Pollard
*Attorney, Agent, or Firm*—Cooper, Dunham, Clark, Griffin & Moran

[57] ABSTRACT

A spring-loaded drawer partition formed of plate members that slide along opposed side walls of a drawer, each including tab extensions extending therefrom toward the inside of the drawer and constituting spring members. A box member extends between the plate members, having open ends which house the tab extensions thereinside. Stop members are included inside the box member, bearing against the tab extensions, yieldably biasing the plate members against the side walls of the drawer.

7 Claims, 4 Drawing Figures

Fig. 1.
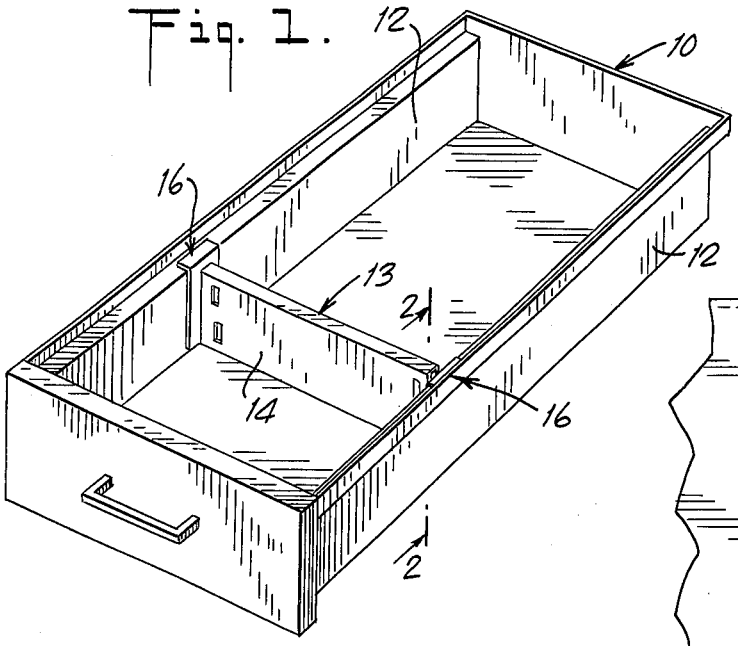
Fig. 2.
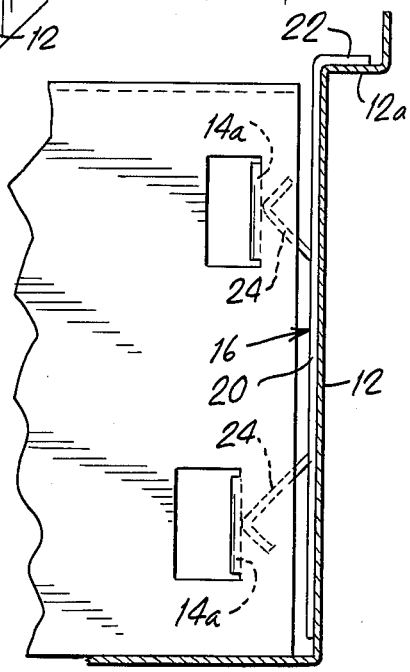
Fig. 3.
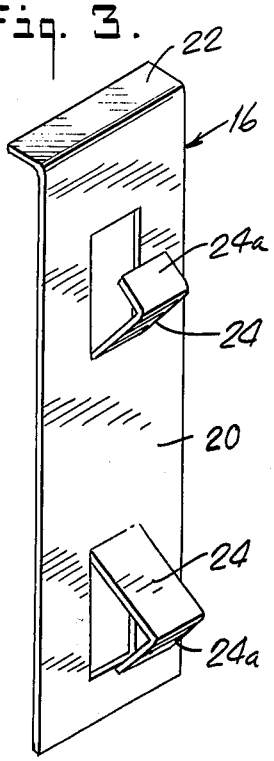
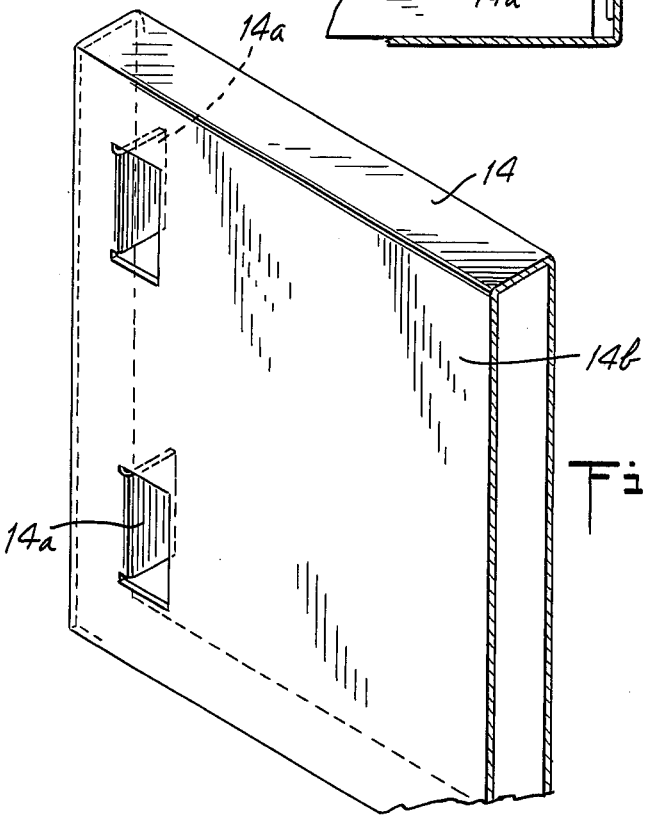
Fig. 4.

SPRING-LOADED DRAWER PARTITION

BACKGROUND AND BRIEF DESCRIPTION OF THE INVENTION

This invention relates to a spring-loaded drawer partition, and particularly provides such a partition in which plate members adapted to slide along side walls of a drawer are yieldably biased against the side walls in a fashion such that none of the spring-loading structure is mechanically exposed.

Spring-loaded drawer partitions are known. The following U.S. patents are representative:

| Patentee | U.S. Pat. No. | Issued |
|---|---|---|
| Hirsch | 417,640 | 17 December 1889 |
| Choate | 1,063,657 | 3 June 1913 |
| Cameron | 2,148,681 | 28 February 1939 |
| Gerkey | 2,163,319 | 20 June 1939 |

All of these patents utilize spring-loading mechanisms which are mechanically exposed and which may hence be interfered with by the contents of the file drawer.

In the present invention, a spring-loaded drawer partition is utilized in which none of the spring-loading mechanism is mechanically exposed, thereby simplifying the operation of the partition in a drawer. Further, the partition uses only three parts, two of which are identical, and hence the partition is easily and inexpensively fabricated.

The invention will be more completely understood by reference to the following detailed description.

BRIEF DESCRIPTION OF THE DRAWING

FIG. 1 is a perspective view of a drawer incorporating a partition embodying the invention.

FIG. 2 is a sectional view, to an enlarged scale, taken along the section 2—2 in FIG. 1.

FIGS. 3 and 4 are perspective views respectively of plate and box members useful in forming a partition presently preferred and embodying the invention.

DETAILED DESCRIPTION

Referring to FIG. 1, a file drawer 10 is shown having opposed side walls 12. A spring-loaded drawer partition 13 is included within the file drawer, and is spring-loaded to move easily along the side walls 12.

The drawer partition 13 is formed from two plate members 16 adapted to slide along the side walls 12 and a box member 14 extending between the plate members 16.

The two plate members 16 are identical and are shown in FIG. 3. Referring to that figure, the plate member 16 includes a first planar portion 20 which bears against the side wall 12. The upper edge of the planar portion 20 is terminated by a flanged section 22 extending at right angles to the planar portion. The flange 22 rides over flange **12*a* of the side wall, as shown in FIG. 2. The plate member 16 includes two tabs 24 integral therewith and extending therefrom toward the inside of the drawer. The tabs 24, which extend inwardly by differing distances (see FIG. 2), may be terminated by end portions 24*a*. The plate member 16 is preferably made of spring metal, so that the tabs 24 constitute spring members, (FIG. 2), corresponding to the different distances by which the tabs 24** extend inwardly.

One half of the box member 14 is shown in FIG. 4. It is rectangular in cross section, open at each of its ends and bottom, and closed at its top. One the inside of each of the open ends there is included stop members **14*a*, located different distances from the adjacent end. These stop members preferably are integral with and formed from the material of the box member 14 by suitable cutting and bending of the side wall 14*b*** of the box member.

FIG. 2 shows the interengagement of the box member 14 and the plate members 16. In particular, the box member 14 is positioned so that the open ends thereof are adjacent the plate members 16, and the tab extensions 24 of the plate members are housed inside the open ends of the box member 14. The tab extensions 24, constituting spring members, bear against the stop members **14*a* so that the plate members 16 are yieldably biased against the side walls of the file drawer. In this fashion the partition 14 may be easily moved along the side walls, while at the same time being biased into any one position. Because the tab extensions 24 and stop members 14*a* are positioned inside the box member 14, all of the spring-loading structure of the file drawer partition is housed inside the box member, thereby preventing interference with the structure by any of the contents of the file drawer. Because the lower tabs 24 extend inwardly greater distances than the upper tabs, the partition 13 may be easily positioned in place by first placing the plate members 16 against side walls 12, lowering the open-bottomed box member 14 over the tabs 24 (the lower stop 14*a* passes by the upper tab 24** without contact) until associated tabs and stops make contact.

It will be appreciated that modifications of the preferred embodiment described above may be made by those skilled in the art without departing from the spirit of the invention. For example, while spring members 24 constituting extensions of the plate members 16 have been disclosed, it would be possible to utilize a stop member that forms an extension of the plate member, with the spring member being included on the inside of and carried by the box member 14. Accordingly, the invention should be taken to be defined by the following claims.

What is claimed is:

1. A spring-loaded drawer partition comprising a plate member adapted to slide along a side wall of a drawer and formed with an extension extending therefrom toward the inside of the drawer, a box member extending between the side walls of the drawer and having an open end thereof positioned adjacent said plate member and housing said extension on the inside thereof, and means yieldably biasing said box member and plate member away from each other to yieldably bias said plate member against said side wall.

2. A partition according to claim 1, in which said extension comprises a tab extending from said plate member toward the inside of said drawer.

3. A partition according to claim 2, in which said box member includes a stop member on the inside thereof bearing against said tab to provide said yieldable urging of said plate member against said side wall.

4. A partition according to claim 3, in which there are two of said plate members positioned against opposite side walls of said drawer, there is a single box member having open ends and extending between said plate members and including a stop member at each end thereof inside thereof bearing against the tab on each plate member, yieldably urging said plate members against said side walls.

5. A partition according to claim 4, in which each plate member includes a pair of said tabs, and said box member includes a pair of stop members at each end thereof bearing against said tabs.

6. A partition according to claim 3, in which said box is open at its bottom, there are a pair of said tabs, one at a higher level than the other, the lower one of said tabs extending inwardly toward the inside of said drawer for a greater distance than the higher tab, and there are a pair of said stop members, one at a higher level than the other, said stop members being positioned at different distances from said open end of said box member corresponding to the different distances by which said tabs extend inwardly.

7. A partition according to claim 1, in which said extension comprises a tab integral with said plate member and extending away therefrom toward the inside of said drawer, said plate member being formed of spring material so that said tab forms a spring member, and said box member includes a stop member on the inside thereof bearing against said tab to provide said yieldable urging of said plate member against said side wall.

* * * * *

UNITED STATES PATENT AND TRADEMARK OFFICE

CERTIFICATE OF CORRECTION

PATENT NO. : 4,081,100

DATED : 28 March 1978

INVENTOR(S) : Benedict F. Presby

It is certified that error appears in the above-identified patent and that said Letters Patent are hereby corrected as shown below:

Column 1, lines 66-68, delete "(Fig. 2), corresponding to the different distances by which the tabs 24 extend inwardly" and insert the same in Column 2, line 5, after "end".

Signed and Sealed this

Seventh Day of November 1978

[SEAL]

*Attest:*

RUTH C. MASON
*Attesting Officer*

DONALD W. BANNER
*Commissioner of Patents and Trademarks*